US011585105B2

(12) United States Patent
Bond

(10) Patent No.: US 11,585,105 B2
(45) Date of Patent: Feb. 21, 2023

(54) SECONDARY JOIST PROFILE FOR GRID SYSTEMS

(71) Applicant: Bond Formwork Systems, LLC, Waller, TX (US)

(72) Inventor: Bradley D. A. Bond, Waller, TX (US)

(73) Assignee: BOND FORMWORK SYSTEMS, LLC, Waller, TX (US)

( * ) Notice: Subject to any disclaimer, the term of this patent is extended or adjusted under 35 U.S.C. 154(b) by 0 days.

(21) Appl. No.: 17/330,059

(22) Filed: May 25, 2021

(65) Prior Publication Data

US 2022/0034106 A1 Feb. 3, 2022

Related U.S. Application Data

(63) Continuation of application No. 17/233,915, filed on Apr. 19, 2021, which is a continuation of application (Continued)

(51) Int. Cl.

| | |
|---|---|
| ***E04G 11/50*** | (2006.01) |
| *E04G 11/48* | (2006.01) |
| *E04G 17/04* | (2006.01) |

(52) U.S. Cl.

CPC ..... *E04G 11/50* (2013.01); *E04G 11/486* (2013.01); *E04G 17/04* (2013.01); *E04G 2011/505* (2013.01)

(58) Field of Classification Search

CPC ... E04G 11/50; E04G 11/52; E04G 2011/505; E04C 3/32; E04C 2003/0404;

(Continued)

(56) References Cited

U.S. PATENT DOCUMENTS 2,010,848 A * 8/1935 Dix ..... E04B 2/842 52/481.2
3,016,116 A * 1/1962 Clevenger ..... E04B 2/7863 52/464

(Continued)

FOREIGN PATENT DOCUMENTS

CA 2698537 A1 * 3/2008 ..... E04G 11/486
CN 102797353 11/2012

(Continued)

OTHER PUBLICATIONS

Translation of FR 2,923,241. (Year: 2009).*

(Continued)

*Primary Examiner* — Michael Safavi
(74) *Attorney, Agent, or Firm* — Nolte Lackenbach Siegel

(57) ABSTRACT

A joist for a formwork grid construction component system is disclosed. Typical joists (sometimes referred to as secondary beams) span a distance of approximately six feet (when fully connected). By strengthening the joist using an altered profile while maintaining interoperable external dimensions, the span distance may be increased. That is, by forming the joists with the disclosed profile, joists can be made longer (e.g., have an eight foot connected span) and maintain appropriate strength or even have an increased weight tolerance. Formwork grid systems are used in construction of buildings and other structures. Interoperability with existing components is maintained by the disclosed joist profile adhering to the same external functional form factor as existing joists. The external form factor being the same allows joists constructed in accordance with this disclosure to properly function with existing formwork grid construction components.

17 Claims, 13 Drawing Sheets

Related U.S. Application Data

No. 16/944,473, filed on Jul. 31, 2020, now Pat. No. 10,982,452.

(58) Field of Classification Search
CPC ..... E04C 2003/0408; E04C 2003/0421; E04C 2003/0443; E04C 2003/0452
See application file for complete search history.

(56) References Cited

U.S. PATENT DOCUMENTS

| | | | | | |
|---|---|---|---|---|---|
| 3,026,977 | A * | 3/1962 | Pollock | E04B 2/7854 | 52/481.2 |
| 3,037,590 | A * | 6/1962 | Pavlecka | E04C 2/08 | 52/481.2 |
| 3,130,470 | A * | 4/1964 | Bowden | E04G 11/48 | 211/186 |
| 3,176,807 | A * | 4/1965 | Pavlecka | E04C 2/40 | 52/561 |
| 3,184,013 | A * | 5/1965 | Pavlecka | E04C 2/08 | 52/275 |
| 3,409,266 | A | 11/1968 | Jennings | | |
| 3,429,090 | A * | 2/1969 | Metelnick | E04B 2/7863 | 52/481.2 |
| 3,562,970 | A * | 2/1971 | Schwartz | A47B 57/00 | 52/36.5 |
| 3,668,827 | A * | 6/1972 | Schwartz | A47B 96/1416 | 52/36.6 |
| 3,862,530 | A * | 1/1975 | Martine | E04B 2/7854 | 52/281 |
| 4,034,957 | A * | 7/1977 | Cody | E04C 3/06 | 249/189 |
| 4,156,999 | A * | 6/1979 | Avery | E04G 11/48 | 52/376 |
| 4,159,604 | A * | 7/1979 | Burrell | E04C 3/292 | 52/376 |
| 4,333,289 | A * | 6/1982 | Strickland | E04G 17/042 | 249/18 |
| 4,441,300 | A * | 4/1984 | Varon | E04B 2/7863 | 211/182 |
| 4,492,358 | A * | 1/1985 | Manderla | E04G 11/38 | 249/18 |
| 4,679,007 | A | 7/1987 | Reese et al. | | |
| 5,175,472 | A | 12/1992 | Johnson, Jr. et al. | | |
| 5,195,045 | A | 3/1993 | Keane et al. | | |
| 5,233,807 | A * | 8/1993 | Spera | E04G 11/12 | 52/837 |
| 5,307,596 | A * | 5/1994 | Bockmiller | E04B 2/7416 | 52/235 |
| 5,394,061 | A | 2/1995 | Fujii | | |
| 5,579,624 | A * | 12/1996 | Aeberhard | E04B 9/064 | 52/586.2 |
| 5,743,058 | A * | 4/1998 | Boomsma | E04B 2/7863 | 52/481.2 |
| 5,996,299 | A * | 12/1999 | Hsueh | E04B 2/7863 | 52/479 |
| 6,209,275 | B1 * | 4/2001 | Cates | E04B 2/7453 | 52/283 |
| 6,260,321 | B1 * | 7/2001 | Rudduck | E06B 1/045 | 52/474 |
| 7,578,110 | B2 * | 8/2009 | Jenkins | E04B 1/24 | 52/481.2 |
| 8,262,056 | B2 | 9/2012 | Schwoerer | | |
| 8,307,607 | B2 * | 11/2012 | Conterno | E04F 10/02 | 52/766 |
| 8,616,519 | B2 | 12/2013 | Bacon | | |
| 8,820,018 | B2 * | 9/2014 | Maley | E04F 13/0869 | 52/506.06 |
| 9,004,443 | B2 | 4/2015 | Zhang | | |
| 10,024,069 | B2 | 7/2018 | Bond et al. | | |
| 10,053,875 | B1 | 8/2018 | Baron | | |
| 10,053,877 | B2 * | 8/2018 | Lenkin | E04B 5/10 | |
| 10,590,665 | B2 * | 3/2020 | Lenkin | E04G 11/486 | |
| 10,711,472 | B2 | 7/2020 | Bond | | |
| 2014/0263941 | A1 | 9/2014 | Zhang | | |
| 2016/0060882 | A1 | 3/2016 | Bond | | |
| 2018/0080238 | A1 | 3/2018 | Lenkin | | |
| 2018/0187437 | A1 * | 7/2018 | Chevis | E04G 17/14 | |
| 2018/0258657 | A1 * | 9/2018 | Chevis | E04G 25/04 | |
| 2018/0340342 | A1 | 11/2018 | Lizarazu et al. | | |
| 2019/0010716 | A1 | 1/2019 | Baron | | |
| 2019/0127996 | A1 * | 5/2019 | Chevis | E04G 17/0651 | |
| 2019/0145115 | A1 | 5/2019 | Bacon | | |
| 2019/0194961 | A1 | 6/2019 | Bond | | |
| 2020/0102764 | A1 | 4/2020 | Bacon | | |

FOREIGN PATENT DOCUMENTS

| | | | | | |
|---|---|---|---|---|---|
| CN | 108868126 | A | | 11/2018 | |
| DE | 2927116 | A1 | | 8/1981 | |
| DE | 3147081 | A1 | | 12/1982 | |
| DE | 3316557 | C1 | | 11/1984 | |
| DE | 4204773 | A1 | | 8/1993 | |
| DE | 202018100307 | U1 | * | 1/2018 | E04G 11/50 |
| EP | 1847665 | | * | 10/2007 | E04G 11/50 |
| EP | 2749713 | A1 | | 7/2014 | |
| EP | 3202998 | A1 | | 8/2017 | |
| FR | 2497862 | A1 | * | 7/1982 | E04G 17/14 |
| FR | 2508958 | A1 | | 7/1982 | |
| FR | 2900176 | A1 | * | 10/2007 | E04G 11/486 |
| FR | 2916466 | A1 | | 11/2008 | |
| FR | 2923241 | | * | 5/2009 | E04G 11/38 |
| FR | 3021985 | A1 | | 12/2015 | |
| GB | 1457136 | | | 3/1974 | |
| GB | 2054691 | | * | 2/1981 | E04G 11/50 |
| GB | 2090901 | | * | 7/1982 | E04G 11/52 |
| GB | 2099902 | | | 12/1982 | |
| JP | 08042163 | A | | 2/1996 | |
| KR | 20090076813 | A | | 7/2009 | |
| KR | 22090076813 | A | | 7/2009 | |
| WO | 2017134135 | A1 | | 8/2017 | |
| WO | 2019156958 | A1 | | 8/2019 | |
| WO | 2009009898 | A | | 1/2020 | |
| WO | WO-2020083935 | A1 | * | 4/2020 | E04G 11/12 |

OTHER PUBLICATIONS

DIN EN ISO 9001, "Slab forming system Ischebeck HV" brochure, USA/HV/LI/11.2009, 12 pages.

Titan HV Slab Forming System, Concrete Support Systems www.concretesupportusa.com, Oct. 2010 74 pages.

* cited by examiner

SECONDARY JOIST PROFILE FOR GRID SYSTEMS

CROSS REFERENCE TO RELATED APPLICATIONS

This application is a continuation of, incorporates by reference, and claims priority to U.S. patent application Ser. No. 17/233,915 which is itself a continuation of U.S. patent application Ser. No. 16/944,473 (now U.S. Pat. No. 10,982,452), filed Jul. 31, 2020, each having the same inventorship and title as the instant application. This application is also related to concurrently pending application for US Patent, entitled, "DROPHEAD NUT FOR FORMWORK GRID SYSTEMS," by Bradley Bond, having application Ser. No. 16/944,483, which is incorporated by reference herein for all applicable purposes. This application is also related to concurrently pending application for US Patent, entitled, "MAIN BEAM PROFILE FOR GRID SYSTEMS," by Bradley Bond, having application Ser. No. 16/944,468, which is incorporated by reference herein for all applicable purposes.

BACKGROUND

Formwork is a type of construction material used in the construction of buildings and other types of architecture projects that typically include concrete sections (e.g., walls, floors). Formwork may be temporary or permanent. Temporary formwork is the focus of this disclosure and differs from permanent formwork at least because temporary formwork is used during the construction process and does not become part of the completed structure (i.e., permanent). Formwork is generally used to assist in creating a "form" into which concrete, or cement may be poured and then allowed to "set" into a hardened material. One typical use for temporary formwork is to support different layers of a building while concrete, or cement floors are poured for each layer (e.g., floor of the building or structure).

In one example, formwork may be used to create a grid system support a roof or ceiling of an already finished floor while the next higher floor is poured. The grid system includes support props (sometimes called "posts" or "shores") that hold main beams that are in turn spanned by joists (e.g., perpendicular to the main beams). The joists support a decking material (usually plywood but may be other materials such as plastic) onto which cement may be poured and allowed to set. In this manner, a building may be constructed from the ground up, one floor at a time. As each layer is built, temporary formwork from a previous layer may be removed (after the cement has sufficiently cured) and relocated to a higher floor to repeat the process of building each layer for subsequent floors of the structure. This disclosure presents multiple aspects to provide for an improved joist (sometimes referred to as a "secondary beam" or "secondary joist").

BRIEF DESCRIPTION OF THE DRAWINGS

The present disclosure may be better understood from the following detailed description when read with the accompanying Figures. It is emphasized that, in accordance with standard practice in the industry, various features are not drawn to scale. In fact, the dimensions or locations of functional attributes may be relocated or combined based on design, structural requirements, building codes, or other factors known in the art of construction. Further, example usage of components may not represent an exhaustive list of how those components may be used alone, or with respect to each other. That is, some components may provide capabilities not specifically described in the examples of this disclosure but would be apparent and known to those of ordinary skill in the art, given the benefit of this disclosure. For a detailed description of various examples, reference be made below to the accompanying drawings, in which:

FIGS. 2A-1 to 2A-4 illustrate a grid system constructed of six foot main beams and six foot joists to illustrate multiple joist runs and components thereof to construct the grid;

FIGS. 2B-1 to 2B-4 illustrate a comparable grid system, with respect to area, of that shown in FIGS. 2A-1 to 2A-4 that has been updated to utilize eight foot joists and form a six by eight grid, according to one or more disclosed implementations;

FIG. 4 illustrates a side view of a joist with the mid-span cut-away and identifies an area that will be shown as a cross-section (different examples of the cross-section are illustrated in FIGS. 5-6), according to one or more disclosed implementations;

DETAILED DESCRIPTION

Figure 1:
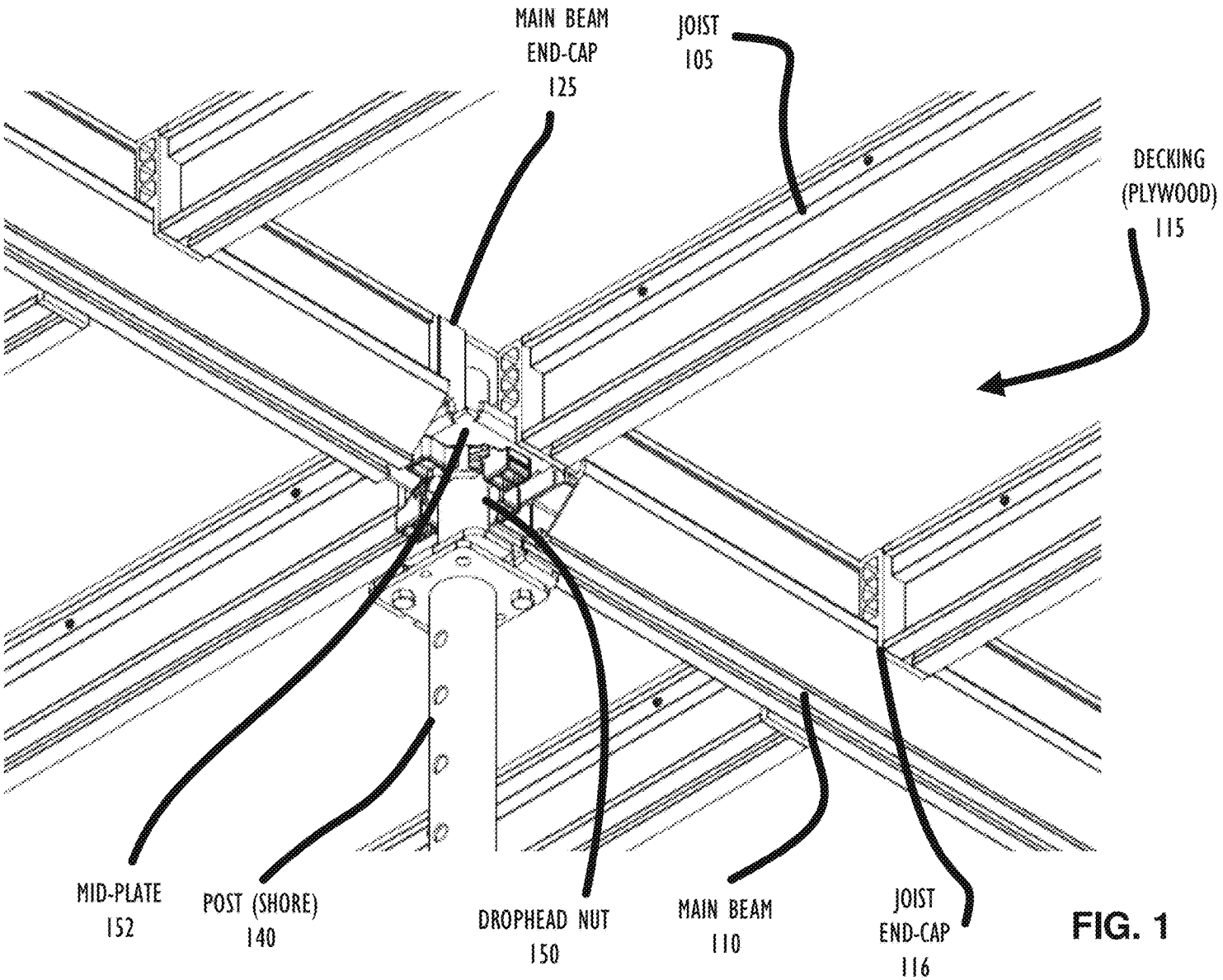
FIG. 1 illustrates a view from below the "pouring surface" that shows a connected set of formwork components for supporting a decking, according to one or more disclosed implementations.

Illustrative examples of the subject matter claimed below will now be disclosed. In the interest of clarity, not all features of an actual implementation are described for every example implementation in this specification. It will be appreciated that in the development of any such actual example, numerous implementation-specific decisions may be made to achieve the designers' specific goals, such as compliance with architectural and building code constraints, which will vary from one usage to another.

In this disclosure the terms "concrete" and "cement" are used interchangeably. Obviously, each of these materials may have different compositions and be used in different building situations. However, for the purposes of this disclosure, the characteristics of the building material and its ultimate supporting strength are not significant. Characteristics that are important for this disclosure include the fact that each of these materials starts out in a nearly liquid form that may be "poured" and then hardens (sometimes referred to as "setting") into a solid structure. The overall weight of the material when in liquid form is also significant for this disclosure because the disclosed formwork must be able to support a given thickness of the wet material while it proceeds through the curing process. Accordingly, usage of the term cement in an example is not to be considered limiting in any way and concrete may also be an option for that example.

In general, formwork is used to support portions of a building itself while the building is being constructed. Formwork may include multiple components that are modular. Each of the components provides specific capabilities and when used together with other formwork components may provide appropriate support characteristics as required for the building's construction parameters (e.g., thickness of slab, placement of permanent support columns). Formwork differs from scaffolding (another type of componentized construction material) in several ways. In particular, scaffolding is designed to provide safety and support for workers, equipment, and combinations thereof during a construction project. Simply put, if the installation is classified as scaffolding, entirely different standards apply than if the installation is classified as shoring (from formwork components). At least two issues, worker safety, and compliance with applicable standards, are involved.

In contrast to scaffolding, formwork is designed to provide appropriate support characteristics for portions of the structure being built. Accordingly, the design specifications, requirements, and other characteristics of scaffolding differ greatly from those of formwork. For example, formwork will support orders of magnitude more weight than scaffolding and scaffolding may be designed to wrap the external facade of a building rather than be internal to the building. There are other differences between scaffolding and formwork that are known to those in the art.

The term "grid systems" generally refers to the set of components of formwork used to create a grid to support decking material such that concrete may be poured to form the floor immediately above the working area of the grid system. For example, a grid system on the ground floor (e.g., foundation) of a building would be installed on that ground floor to support pouring of concrete to create the floor of the second story of the building (or possibly the roof of a one-story building). Once the floor of the second story has cured, the grid system may be disassembled and relocated to the newly built floor to support pouring of the third story. This process may be repeated as many times as there are floors (i.e., stories) of the building.

Grid systems include, among other components, shores, or posts to provide vertical support, main beams to provide lateral support across the shores, and joists that span across main beams to provide support for a decking material. In formwork terminology, joists may be referred to as "secondary beams," "secondary joists," or some other term to distinguish them as the spanning support (above the main beams) for the sheathing or decking material. This disclosure provides information regarding an improved secondary joist that is stronger, lighter per length (i.e., lighter per foot of joist), and includes an altered secondary joist profile. The disclosed secondary joist remains compatible with existing grid systems, in part, because the joist maintains external interoperable dimensions with respect to other components (e.g., has an "interoperable form factor").

As used herein, the term "six foot joist" refers to a joist that is 1.7 m in actual length which is slightly shorter than six feet. This length of joist is typically referred to simply as a six foot joist, because, when connected with additional formwork components they may be used to create a grid that is almost six feet from center to center of the main beams that are perpendicular to that joist. That is, the additional distance, when measured center to center, is provided as part of the cross beams joining at another cross beam or at a drop head. Similarly, the term "eight foot joist" refers to a joist that is 2.3 m in actual length. This length of joist is typically referred to as an eight foot joist, because, when connected with additional formwork components they may be used to great a grid that is almost eight feet from center to center of the main beams that are perpendicular to that joist. Specific test measurements for different example implementations are provided as an appendix to this Specification.

Referring now to FIG. 1, formwork grid system 100 illustrates several of the components discussed above configured to function together as an example of their use in construction. The view provided in FIG. 1 of formwork grid system 100 is from below and includes decking 115 that will most likely be plywood as the uppermost layer (decking 115 illustrated as background in FIG. 1 and would rest on top of, or be attached to, the top of the main beam 110 and joist 105 components. As mentioned above, a configured formwork grid system 100 would support pouring of wet cement onto the decking layer opposite and upper most side of decking 115 shown in FIG. 1. Once that cement has cured the formwork components shown in FIG. 1 may be removed (e.g., as part of reshoring). The removal process is sometimes called "stripping." After removal, it is likely that these components may be repositioned within the same structure (e.g., moved to another level) to be re-used to continue the layered building process.

As illustrated in FIG. 1, formwork grid system 100 includes a joist 105 that spans between two (or more) main beams 110 to support decking 115. As shown in FIG. 1, joists 105 and main beams 110 "join" or "connect" to a support post 140 via a drophead nut 150. Joists 105 may also join or connect to a main beam 110. Although shown engaged in the example of FIG. 1, joists 105 may also rest on top of and span across a set of main beams 110. As illustrated, each joist 105 may include a joist end-cap 116 that would (if desired) align with a mid-plate lip (e.g., lip of mid-plate 152) or similar connection point on a main beam 110. This concept is illustrated here by main beam end-cap 125 which is shown "connected" to drophead nut 150 at a lip of mid-plate 152. Alternatively, as mentioned above, each joist 105 may simply overlap main beam 110. A combination of joists 105 and main beams 110 would collectively work to support a platform of decking 115 (e.g., plywood). Although plywood is most commonly used for decking 115, other materials (e.g., metal, plastic) may be used to provide decking support.

FIG. 1 also illustrates post (shore) 140 that is directly below drophead nut 150. As explained above, the combination of post 140 with drophead nut 150 provides vertical support for each main beam 110 and/or joists 105. These beams in turn support decking 115. To remove formwork grid system 100 (after curing of the cement layer above decking 115), a rotational nut on drophead nut 150 would be spun (rotated) enough to align its retention pin gap (not visible) with a retention pin (not visible) of the drophead nut 150. As is understood in the art, rotation to disengage the rotational nut of drophead nut 150 may be performed by striking an impact surface of the rotational nut to effect rotation. Upon alignment of gaps in both the rotational nut and mid-plate 152 with the retention pin of a post in the center of drophead nut 150, drophead nut 150 would change from an engaged position to a collapsed position with mid-plate 152 and the rotational nut that are directly below mid-plate 152 (when engaged); dropping toward post 140 to release upward support on main beam 110 and allow for disassembly of formwork grid system 100.

Figures 1, 2A:
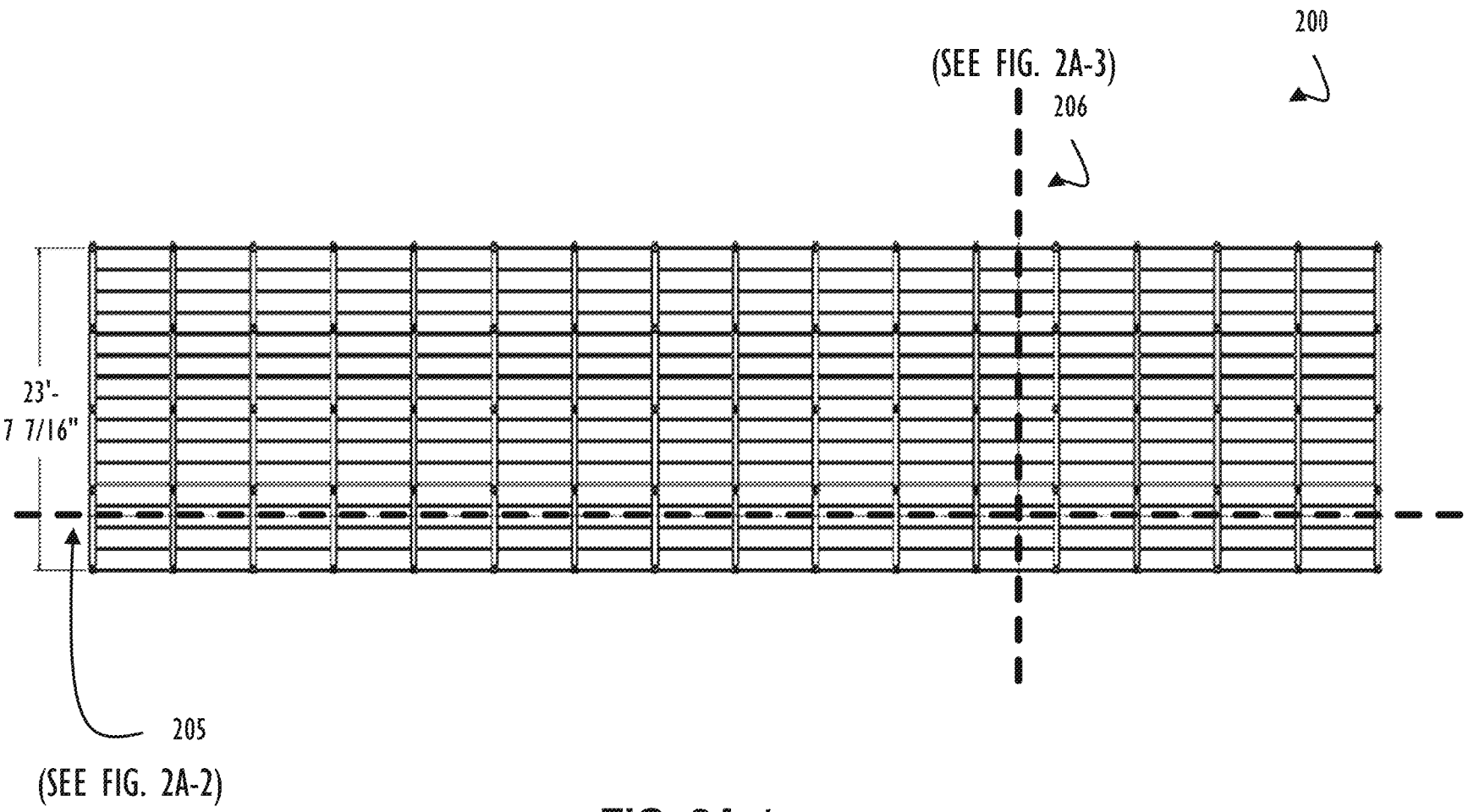
Figures 2, 2A:
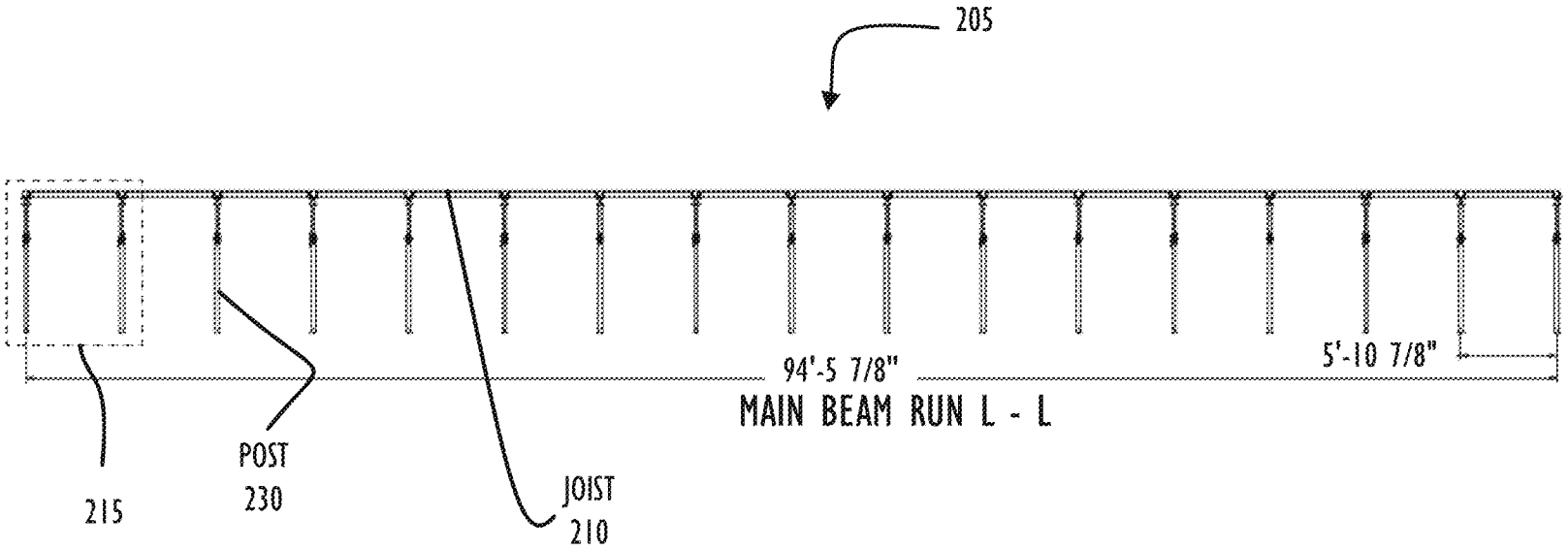
Figures 2, 2A, 3:
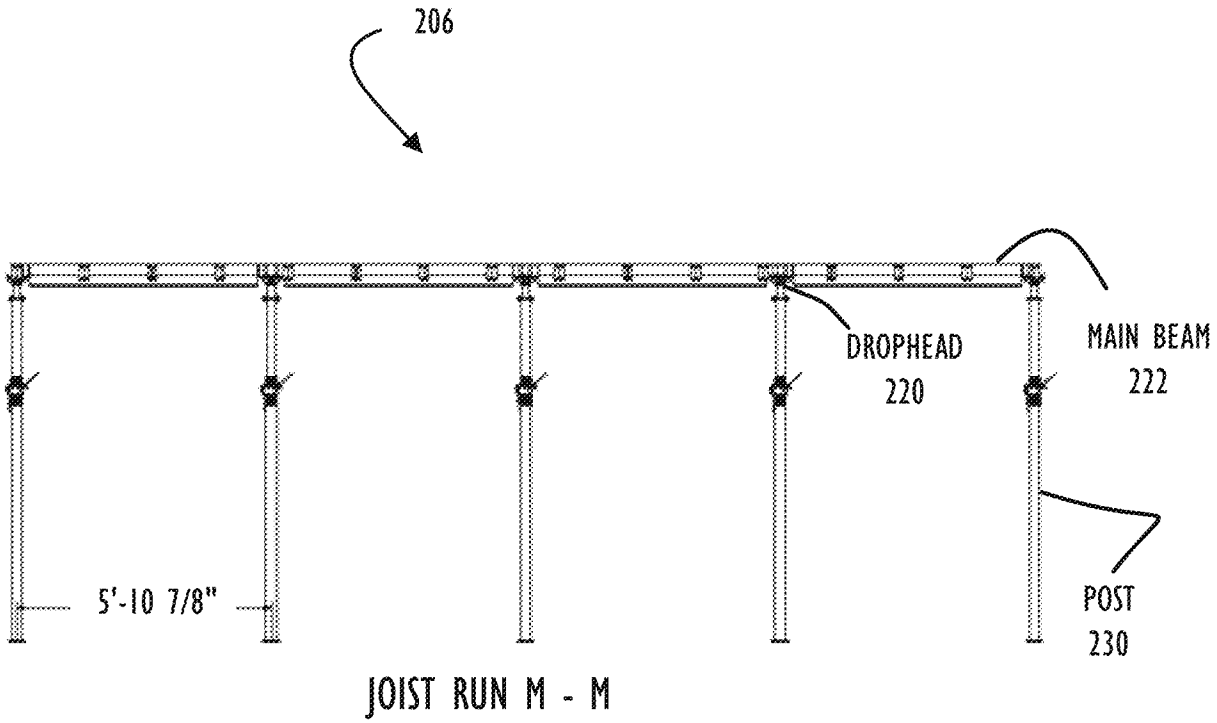
Figures 2, 2A, 3, 4:
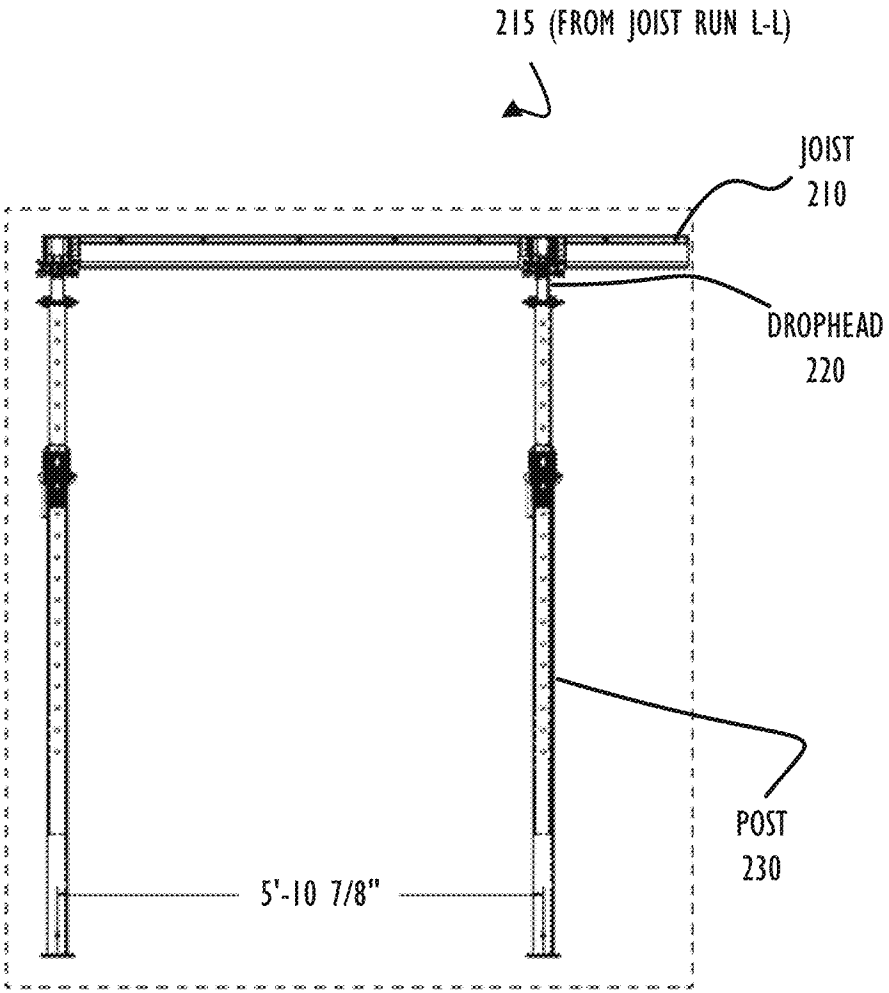
Figures 1, 2B:
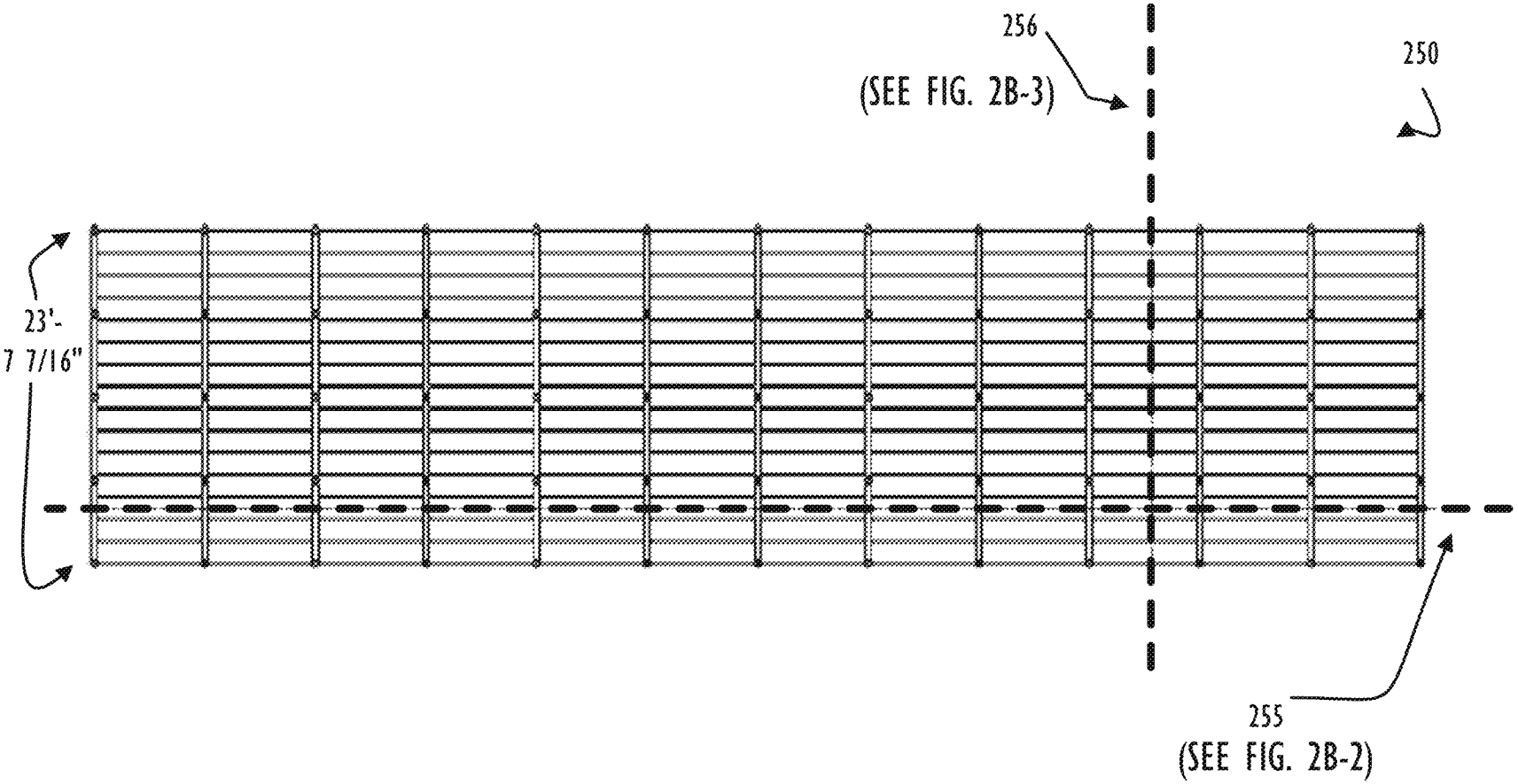
Figures 2, 2B:
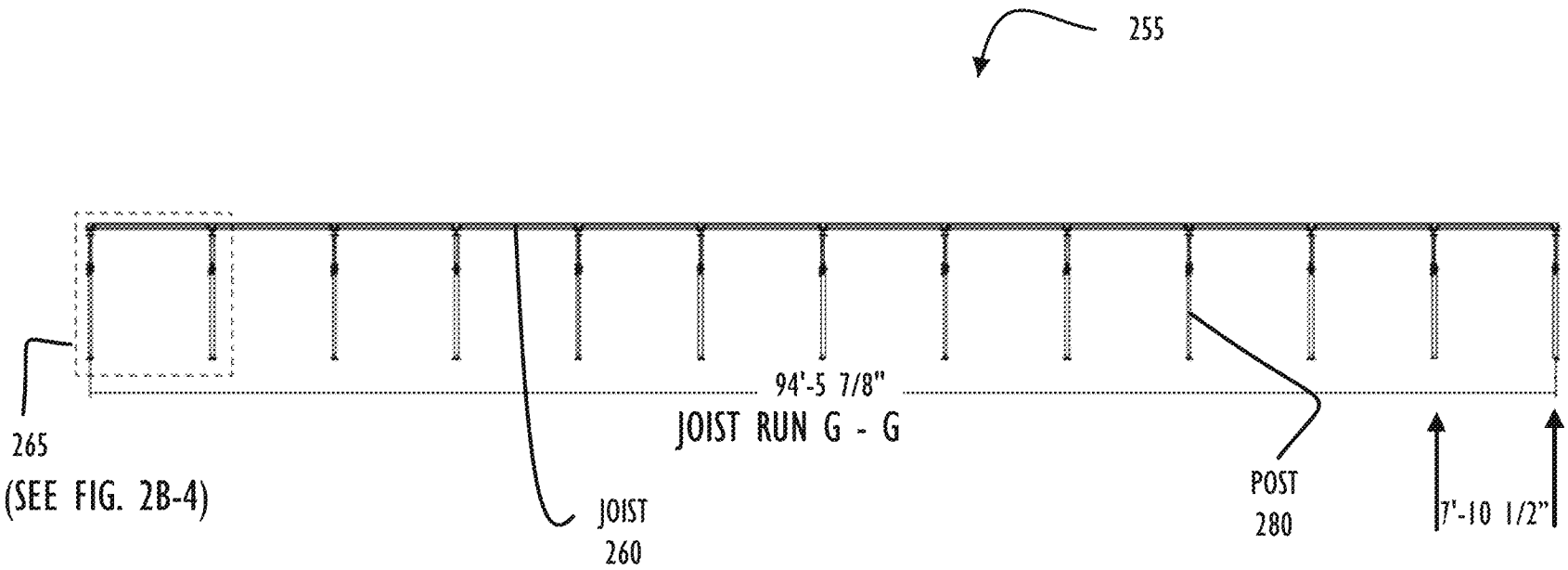
Figures 2, 2B, 3:
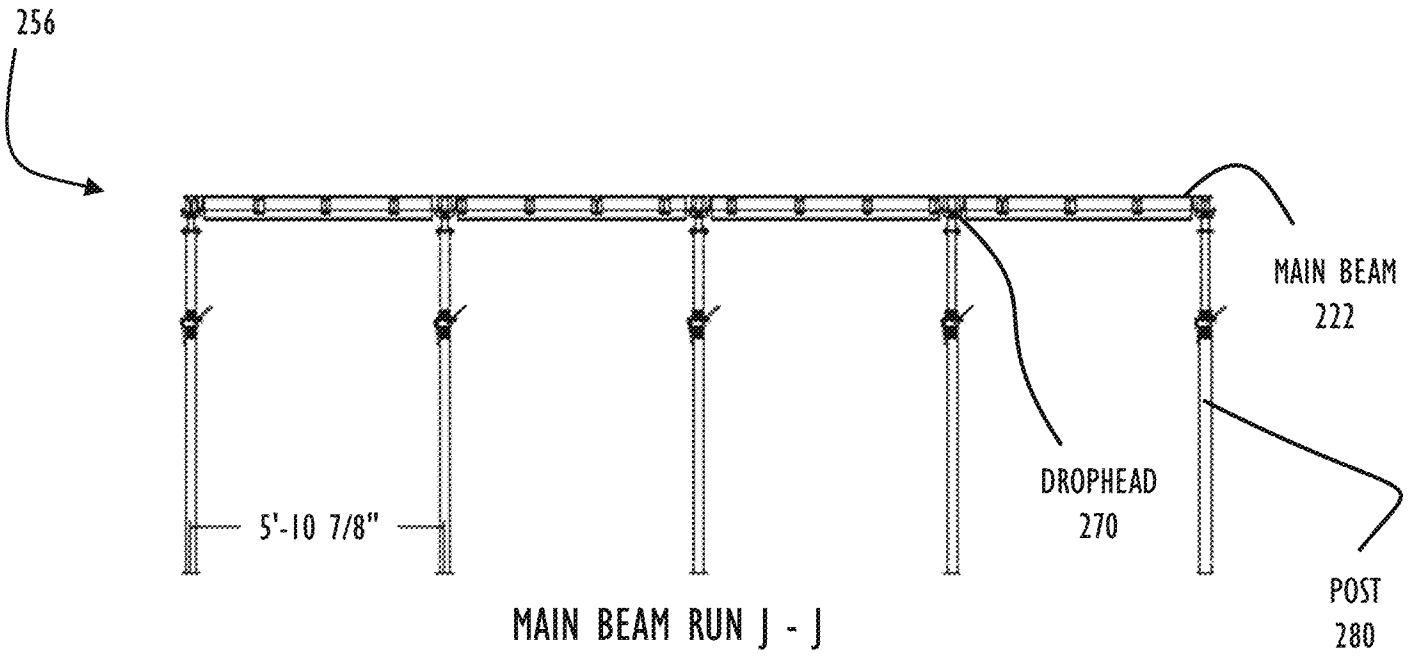
Figures 2, 2B, 3, 4:
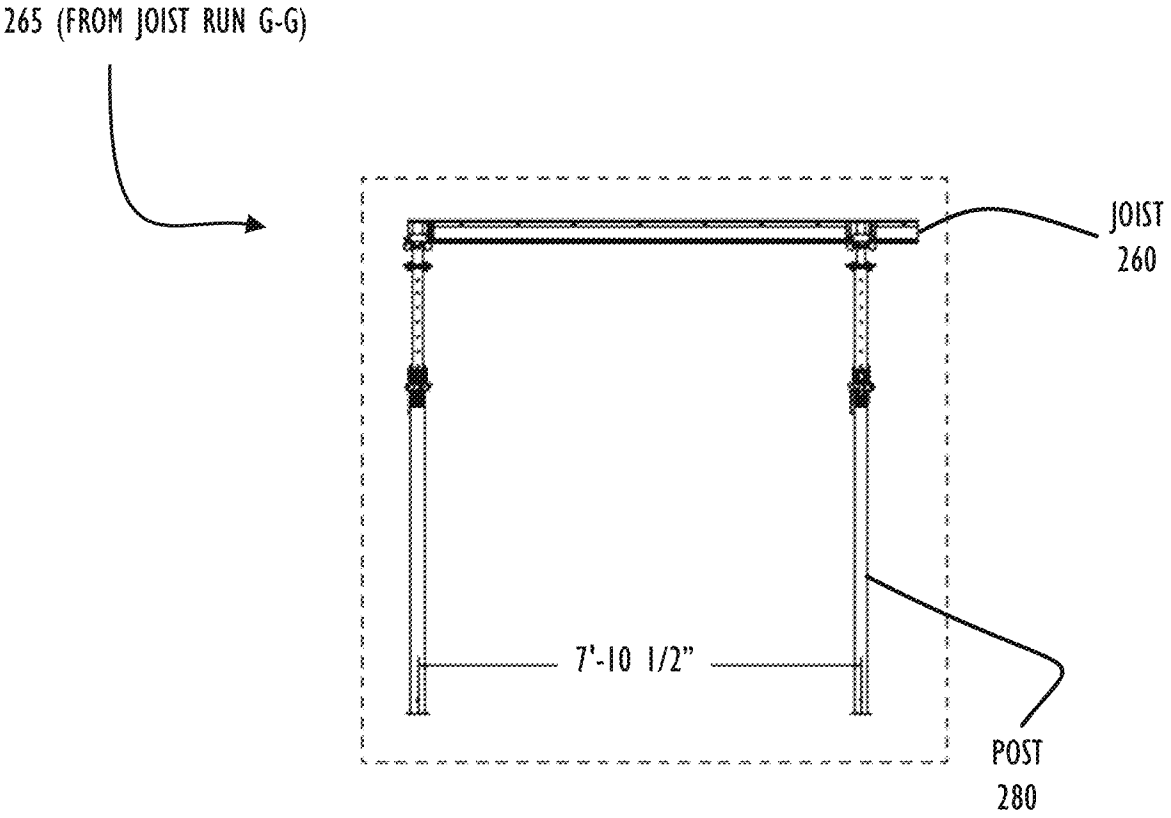

Referring now to FIGS. 2A-1, 2A-2, 2B-1, and 2B-2, two different examples of span for joists and corresponding formwork components are illustrated. Specifically, FIGS. 2A-1 to 2A-2 illustrate a first grid system for a defined area of 23'-7 7/16" by 94'-5 7/8" that is constructed of six foot main beams and six foot joists. To illustrate the reduction of components as discussed herein, FIGS. 2B-1 to 2B-2 illustrate a second grid system for the same defined area that is constructed of six foot main beams and eight foot joists. Each of the illustrations initially show an overall grid system and identify a vertical and horizontal cross section that is then enlarged to elaborate on the detail of each main beam run and joist run. Specifically, FIG. 2A-1 illustrates grid system 200 that includes cross sections M-M for main beams and L-L for joists. Section L-L 205 is then shown enlarged at the bottom of FIG. 2A-1. FIG. 2A-2 continues the enlargement process by illustrating section M-M 206 and area 215 that is a further enlarge end portion of the joist run shown for cross section L-L.

These examples highlight that use of a longer joist (e.g., 8 foot versus 6 foot) may reduce an overall amount of formwork components needed to support an area of decking. The longer span allows for less parts (i.e., a lower number of formwork components to establish a given support structure) to be used. In some cases, the savings are as much as 25% to 40% (or more) with regard to the number of components. The reduction in amount of total formwork components needed provides many benefits. Specifically, the overall weight of components to transport to a job site is reduced (freight cost reduction), cost to rent or buy the components is reduced, the amount of time required to construct the formwork components is reduced (labor cost reduction), fewer components increase overall safety (less labor effort reduces potential for worker injury), and in general provides a more cost effective solution over prior art systems.

Additionally, longer joists allow for increased flexibility in contractor designs that may allow the contractor to miss more columns, walls, and pipes in the slab when creating the formwork grid system. In this disclosure, and in the industry, it is common to refer to a joist as either a six foot joist or an eight foot joist which reflects the grid size built by that particular joist. However, a six foot joist is 1.70 meters in actual length (5'-6.9375") which is slightly shorter than six feet. As explained above, the additional span for the grid to have six foot segments is realized by the width of the connection components between spanning grid components (e.g., main beams and joists). Examples of connection components that add the incremental amounts to result in equal grid sizes are drop head nuts, endcap connections, etc., that are used to join components to form a longer span as discussed in FIGS. 2A-1 through 2B-2.

These concepts of savings are illustrated in a simplified yet detailed example that is illustrated in FIGS. 2A-1 through 2B-2. In FIGS. 2A-1 and 2A-2, a grid system 200 is illustrated with several joist runs of just over 94 ft. each. In this example each joist 210 is just under six ft. in length. A single joist run 205 is illustrated as a cross-section L-L of grid system 200 and enlarged just below the grid system 200 to illustrate more detail for the single joist run 205. Running perpendicular to each joist run 205 in grid system 200 is a main beam run 206 that is illustrated as cross section M-M shown in enlarged detail on FIG. 2A-2. At the bottom of FIG. 2A-2, a portion of single joist run 205 is then further enlarged in portion 215. The portion 215 illustrates two posts 230, each with a drophead nut 220, and a single joist 210 spanning between them. This pattern is repeated to create the single joist run 205. In this example, a single joist run 205 includes 17 posts 230, 16 joists 210, and 17 drophead nuts 220 (main beams 222 are the same across each of these two examples).

Turning to FIGS. 2B-1 and 2B-2, the simplified example of FIGS. 2A-1 and 2A-2 is repeated with a substitution of eight ft. joists 260. Again, grid system 250 includes a plurality of joist runs and has a cross section G-G as a single joist run 255. Single joist run 255 is enlarged below grid system 250 and a portion 265 of that single joist run is further enlarged on FIG. 2B-2. FIG. 2B-2 also illustrates cross section J-J which is a single main beam run 256 from grid system 250. In this example, a single joist run 255 includes 13 posts 280 (savings of 4), 12 joists 260 (savings of 4), and 13 dropheads 270 (savings of 4). Thus, when this pattern is repeated to form complete grid system 250, there is a substantial reduction of number of formwork components that are utilized. As the comparison above explains, utilizing longer span joists may result in an overall reduction in formwork components for the same job site.

As disclosed herein, improved joist profiles (i.e., altering shape and amount of alloy material at angular and other portions of the profile) and use of enhanced materials (e.g., stronger aluminum alloy) in construction of joists allows for an increased strength and span while maintaining interoperability with other existing formwork components. The overall width and height of a joist beam may be maintained while increasing length. That is an "interoperable form factor" at points of connection between formwork components may be maintained while having increased performance of the intervening joist portion (i.e., the span). Known prior art systems that increase a joist beam length over six ft. routinely alter their profile such that they do not have an "interoperable form factor" as disclosed herein and thus cannot function interchangeably with existing formwork components.

To increase strength and lengthen joist beam span, profile changes have been determined that are discussed in more detail below. Further elements used to create each joist beam may be enhanced. For example, an alloy with 37 min KSI yield may be used as opposed to 35 KSI yield as found in existing systems. KSI is a measure of strength (e.g., tensile strength or yield strength). Specifically, K reflects 1,000 pounds and SI refers to a square inch. Yield Strength (mathematically referenced as "F(y)") refers to the stress a material can withstand without permanent deformation or a point at which it will no longer return to its original dimensions (by 0.2% in length). Tensile Strength (mathematically referenced as "F(u)") refers to the maximum stress that a material can withstand while being stretched or pulled before failing or breaking. Accordingly, an alloy with 37 min KSI yield strength and tensile strength reflects an alloy that could withstand 37,000 pounds per square inch without bending or breaking. When using these numbers to rate formwork components (and other items) an F(y) or F(u) is generally provided as a "minimum" amount. That is, the component is rated to withstand at least that much stress but may be able to withstand more than that amount. Thus, an engineer may use the minimum numbers to have confidence their design will remain stable to its expected stress conditions.

Figures 3A, 3B, 3C:
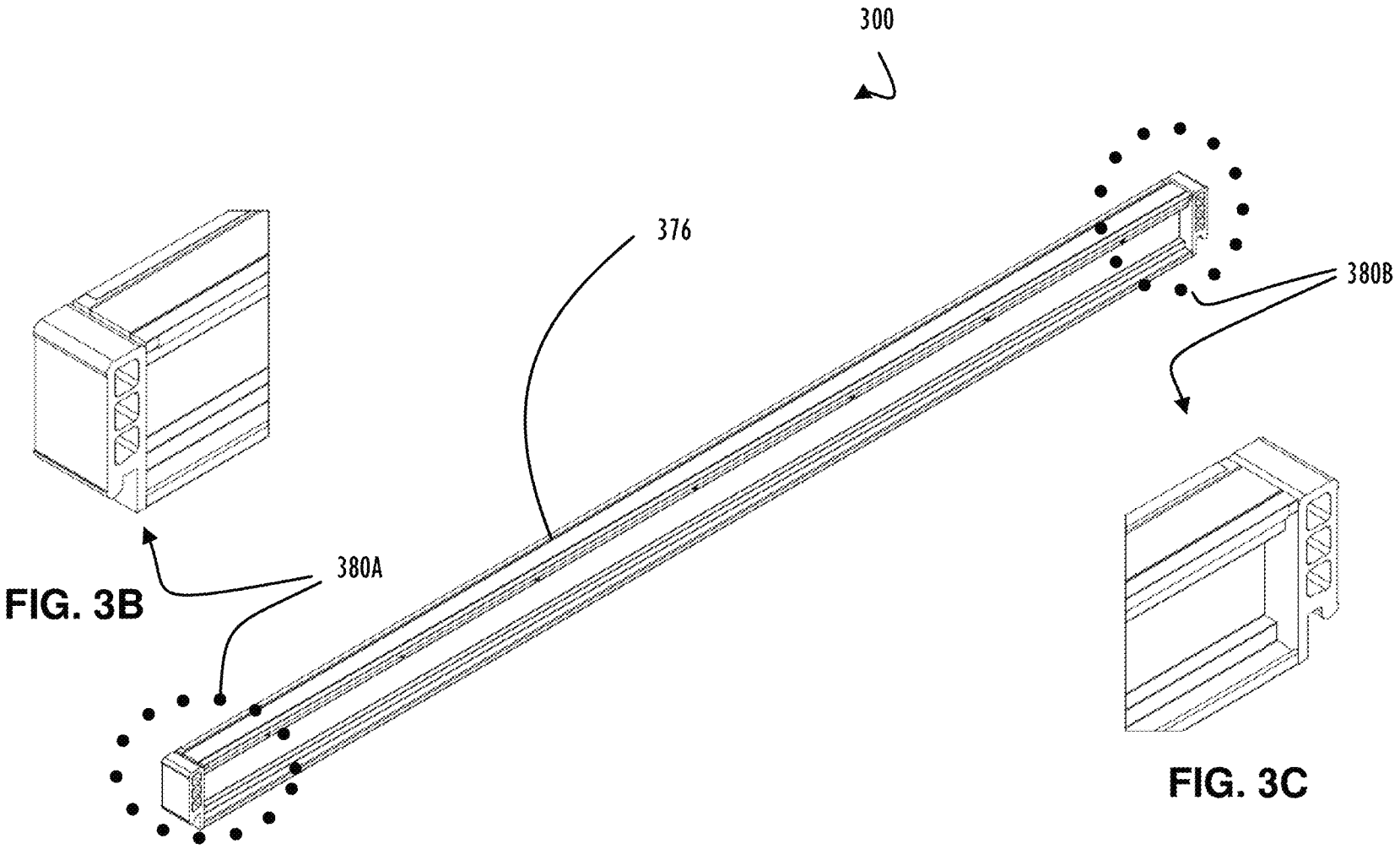
FIGS. 3A-C illustrate a joist with endcaps attached (e.g., welded onto each end), according to one or more disclosed implementations.
Figure 4:
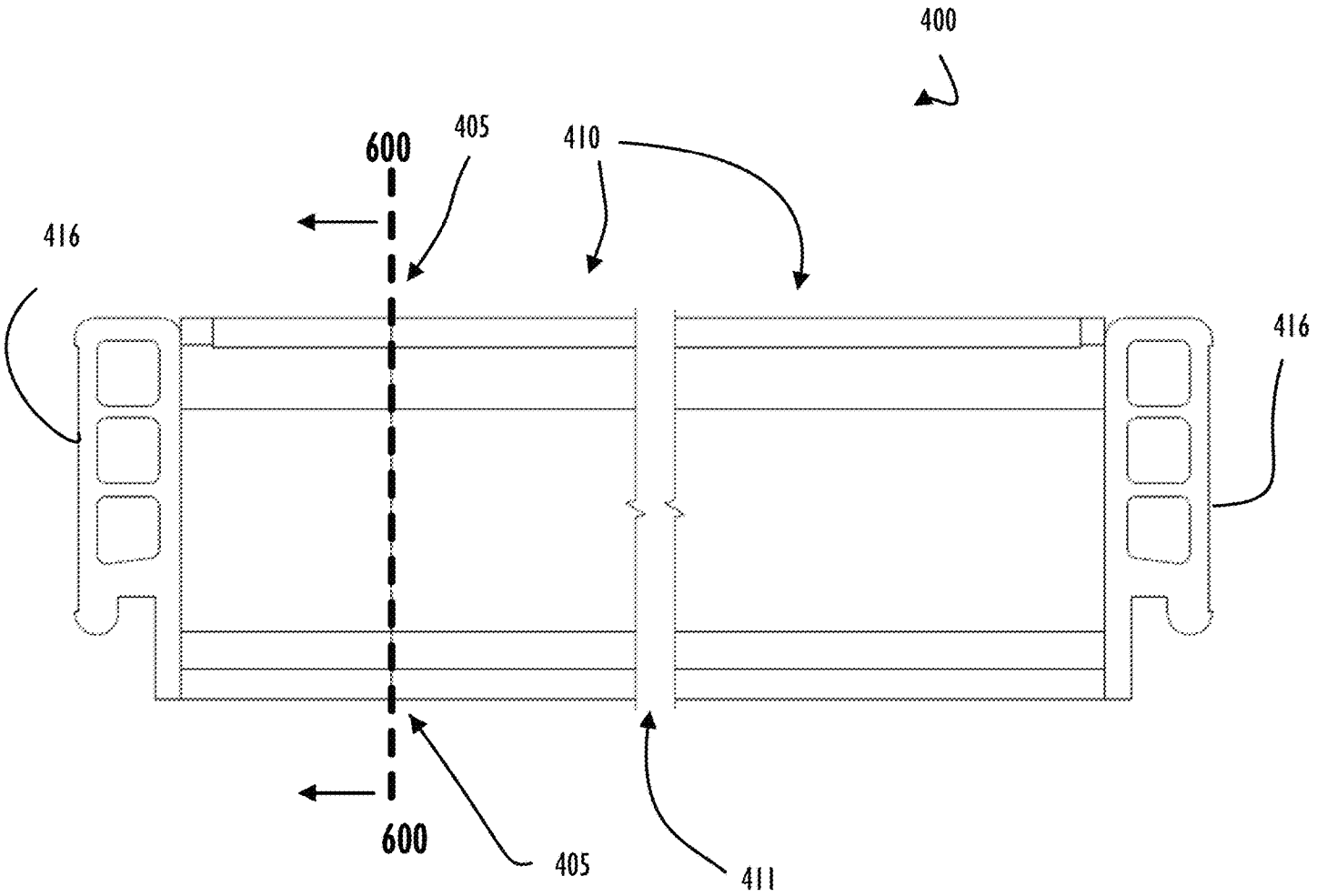

Referring now to FIGS. 3A-C, a joist 300 is illustrated, according to one or more disclosed implementations. Joist 300 is illustrated with attached endcaps 380A and 380B that are additionally shown as enlarged cutouts. Example joist 300 includes endcaps 380A and 380B that are welded onto each end of middle joist component 376. Each of endcaps 380A and 380B may be used to connect a joist to a drophead's mid-plate lip as discussed above in FIG. 1. Middle joist component 376 provides strength for the above referenced span (i.e., length provided by a given joist) and may have different joist profiles as discussed further below. Goals of joist profiles include providing maximum supporting strength while minimizing weight of a joist and providing durability to the joist so that it is not easily damaged during use at a construction site (e.g., rugged environmental and use conditions). Disclosed joist profiles further maintain an interoperable form factor with prior art formwork components to allow interchangeable operation where appropriate.

Figure 5:
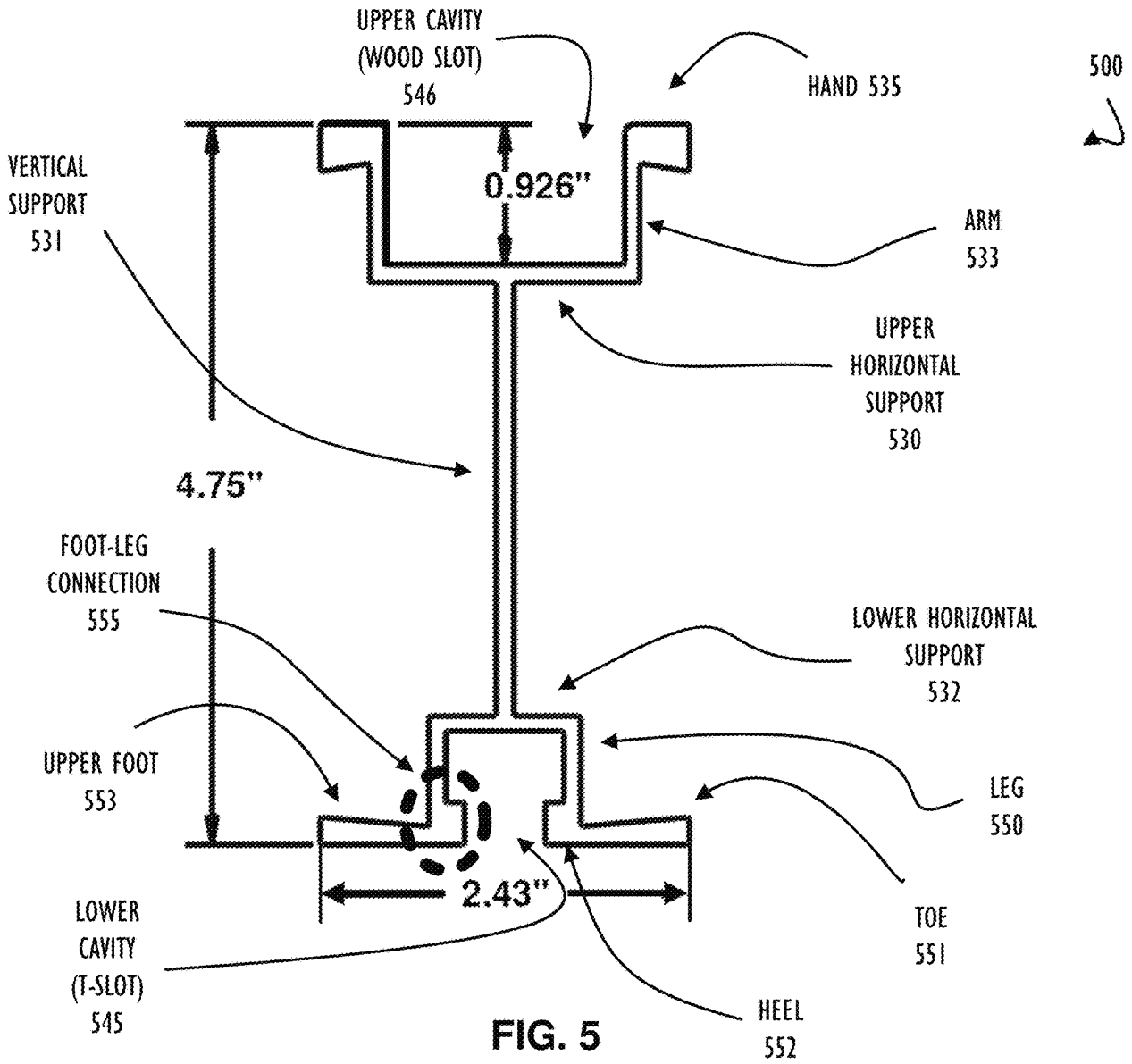
FIG. 5 illustrates a first example cross-section (to illustrate a first "joist profile") of a joist or secondary beam, according to one or more disclosed implementations.
Figure 6:
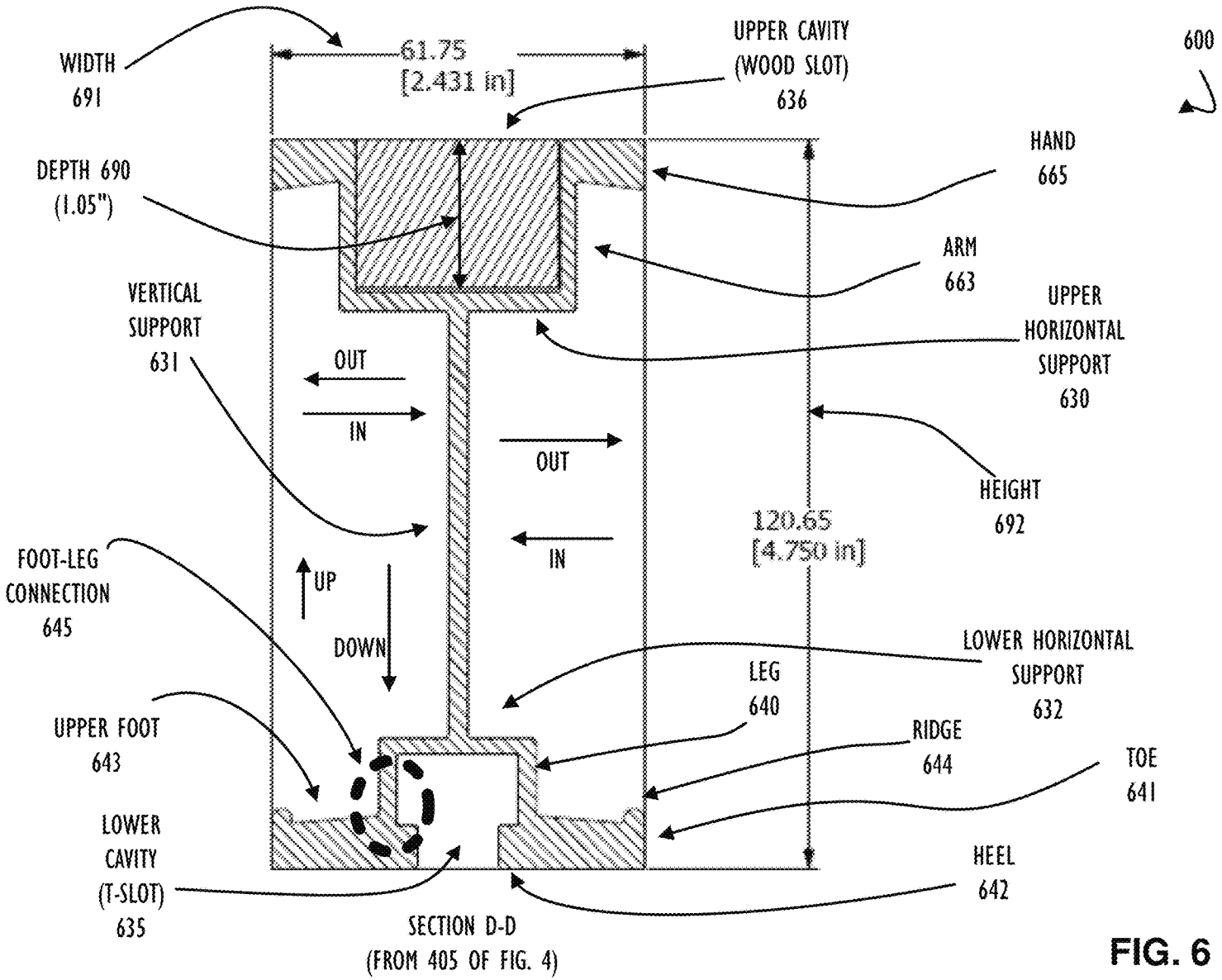
FIG. 6 illustrates a second example cross-section (to illustrate a second "joist profile") of a joist or secondary beam that may support a longer span than the profile of FIG. 5, according to one or more disclosed implementations.

Referring now to FIG. 4, a side view of a joist 400 is illustrated, according to one or more disclosed implementations. In the side view of FIG. 4, joist 400 has the mid-span cut-away as indicated by gap 411. Joist 400 also has a portion that identifies an area that will be shown and discussed below as a cross-section D-D indicated by arrows 405 at the top and bottom of joist 400. Different examples of the cross-section D-D are illustrated in FIGS. 5-6 to identify areas of alteration to allow for longer spans of a given joist 400 (e.g., increasing from a 6 foot (1.7 meter) span to an 8 foot (2.4 meter) span or larger). Joist 400 includes two side portions 410 on either side of gap 411. Each side portion 410 further include an end-cap 416 that may be welded onto a respective side portion 410. The end-caps 416 of FIG. 4 represent a different view of the end-caps 380A and 380B of FIGS. 3A-C.

Referring now to FIGS. 5 and 6, a first example cross-section (to illustrate a first "joist profile" 500) of a joist or secondary beam is illustrated, according to one or more disclosed implementations. The first example joist profile 500 has elements that are sufficient to produce at most a six foot joist and alterations to these elements and additional elements will be discussed below with reference to FIG. 6 where the second joist profile 600 is sufficient to produce an eight foot joist (or more). Each of the first joist profile 500 and the second joist profile 600 maintain an outer dimension such that their external form factor remains consistent with each other and existing formwork components. That is, a joist produced with either the first joist profile 500 or the second joist profile 600 will work interoperably with existing drophead nuts (e.g., drophead nut 450 of FIG. 1), existing joist endcaps, and other formwork components.

In FIG. 5, joist profile 500 includes an upper horizontal support 530 and a lower horizontal support 532 with a vertical support 531 running between them. Each horizontal support extends outwardly from vertical support 531 and makes a ninety degree turn toward the next identified portion. Two arms 533 extend above upper horizontal support 530 and two legs 550 extend below lower horizontal support 532. At the top of each arm 533 is a hand 535 protrusion and in between the two arms 533 (and above horizontal support 530) is formed an upper cavity 546. In use, upper cavity 546 may be used to hold a wood slat to which a decking material (e.g., decking plywood 115 of FIG. 1) may be attached. The attachment is usually provided by nailing the decking layer to a wood slat within upper cavity 546.

Another lower cavity 545 is shown below lower horizontal support 532 and between the two legs 550. At the end of each leg 550 are additional horizontal portions that are individually identified as heel 552, toe 551, and upper foot 553 that may be collectively referred to as a foot of the joist profile 500. Note, as illustrated in the area surrounded by the ellipses identified as foot-leg connection 555, joist profile 500 has the connection between upper foot 553 to leg 550 including reinforcement provided on the opposite side from toe 551 (i.e., interior side) where the reinforcement extends heel 552 on the interior side of leg 550 above the level where upper foot 553 meets leg 550. This area of reinforcement is to strengthen the connection between leg 550 and the foot portion.

FIG. 6 illustrates a second example cross-section (to illustrate a second "joist profile" 600) of a joist or secondary beam that may support a longer span than the profile of FIG. 5, according to one or more disclosed implementations. To aid in discussion, joist profile 600 has been labeled with some of the same element names as joist profile 500 of FIG. 5. However, attributes of these same elements have been altered in joist profile 600 to increase strength and allow for a longer span for a joist (e.g., joist 400 of FIG. 4) such that joist profile 600 with its other disclosed changes may be able to provide for eight foot joists. Also remember that joist profile 600 has been designed to maintain an interoperable form factor as discussed above such that external measurements are not altered in a manner to adversely affect interoperability. That is the joist profile elements of joist profile 600 do not extent beyond the identified 2.430 inch horizontal width 691 measurement or the 4.750 inch vertical height 692 measurement. Also note that depth 690 of upper wood cavity 636 has been increased.

As mentioned above, joist profile 600 provides an upper cavity 636 between two hands 665 that are attached to two arms 663 above upper horizontal support 630. The interior surfaces of each arm 663 and upper surface of upper horizontal support 630 form upper cavity 636. Upper cavity 636 in joist profile 600 is deeper than upper cavity 546 by about $1/8^{th}$ of an inch to allow a #6 common nail to penetrate into upper cavity 636 without impacting the top surface of upper horizontal support 630 (e.g., to prevent bending of the nail upon securing a decking surface (e.g., plywood decking 115 of FIG. 1) to a wood slat (not shown) inside upper cavity 636.

To increase strength of joist profile 600 over joist profile 500 some adjustments in manufacturing have been provided and are now outlined. Other embodiments may have still further adjustments than those specifically listed here. Additional material (e.g., 37 KSI yield aluminum alloy) has been added to each hand 665 to make them thicker and provide additional strength. To be clear, in some implementations, the entire profile is constructed of additional amounts of improved alloy (e.g., 37 KSI yield rather than 35 KSI yield). The combination of the stronger material and/or more of the alloy material (i.e., to make specific portions of the joist profile thicker) results in an entire profile that may be used to create joists that are substantially stronger (and thus support longer spans) than prior art profiles were capable of providing.

Continuing with FIG. 6, hands 665 are larger throughout their cross section than the hands 535 of joist profile 500 and are specifically larger at their external point than where they meet with arm 663 such that the connection between arm 663 and hand 665 forms less than a ninety degree right angle. Additional material (e.g., 37 KSI yield aluminum alloy) has additionally been added to each of upper horizontal support 630 and vertical support 631 such that they are thicker than the corresponding aspects of joist profile 500.

The connection area, identified by the ellipses labeled foot-leg connection 645, that is between each foot (horizontal portion of joist profile 600 including toe 541 and heel 642) and leg 640 has been altered for joist profile 600 with respect to the corresponding aspects of joist profile 500. Specifically, the connection between each foot and leg 640 has been altered for joist profile 600. In joist profile 600, heel 642 meets with leg 640 at a point (illustrated as foot-leg connection 645) below (relative to the top of FIG. 6) where upper foot 643 meets with leg 640. In the example of FIG. 5, the opposite is shown where the heel 552 meets leg 550 above upper foot 553. Further, toe 641 has been enlarged to have a ridge 644 above upper foot 643 portion. These changes are accomplished, in part, by adding extra material (e.g., 37 KSI yield aluminum alloy) to make each foot thicker in addition to providing the ridge 644 at toe 641. Ridge 644 allows joist profile 600 to provide yet another advantage in addition to improved strength. For example, joist profile 600 may be "clipped" to another member by using ridge 644. Clips (not shown) that may be used include R12×50 clips that can connect main beams and joists together. Clips and different techniques for clipping joists and main beams together are discussed in more detail in the above referenced applications that are incorporate herein.

Finally, joist profile 600 includes a lower cavity 635 directly below lower horizontal support 632 and in between each of legs 640. In some cases, lower cavity 635 maintains internal dimensions of lower cavity 545 (e.g., for interoperable use with prior formwork components). In some cases, clips may utilize ridge 644 and/or lower cavity 635 to form a connection between a joist and another component. In summary, the general shape has not been significantly altered between joist profile 500 and joist profile 600, but specific portions of the joist profile 600 have been altered to change their shape, add additional material, or a combination thereof to result in a significantly stronger joist profile that supports joists of longer spans. In this manner, joist profile 600 may be used to construct eight foot span joists (secondary beams) for use as formwork components.

While the embodiments are described with reference to various implementations and exploitations, it will be understood that these embodiments are illustrative and that the scope of the inventive subject matter is not limited to specifically disclosed implementations. Many variations, modifications, additions, and improvements are possible.

Plural instances may be provided for components, operations, or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

Certain terms have been used throughout this description and claims to refer to particular system components. As one skilled in the art will appreciate, different parties may refer to a component by different names. This document does not intend to distinguish between components that differ in name but not function. In this disclosure and claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first component couples to a second component, that coupling may be through a direct connection or through an indirect connection via other components and connections. In this disclosure a direct connection will be referenced as a "connection" rather than a coupling. The recitation "based on" is intended to mean "based at least in part on." Therefore, if X is based on Y, X may be a function of Y and any number of other factors.

The above discussion is meant to be illustrative of the principles and various implementations of the present disclosure. Numerous variations and modifications will become apparent to those skilled in the art once the above disclosure is fully appreciated. It is intended that the following claims be interpreted to embrace all such variations and modifications.

What is claimed is:

1. A joist beam for formwork construction, the joist beam having a joist profile including:

a single vertical support having a top and a bottom;

a lower horizontal support having a first midpoint, the first midpoint connected to the bottom of the single vertical support;

an upper horizontal support having a second midpoint, the second midpoint connected to the top of the single vertical support;

two leg supports at opposite ends of the lower horizontal support, each of the two leg supports connected to the lower horizontal support and extending in an opposite direction from the lower horizontal support relative to the single vertical support;

a first leg support, of the two leg supports, at a first end of the lower horizontal support;

a second leg support, of the two leg supports, at a second end of the lower horizontal support;

a first foot portion connected, via a first foot-leg connection, to the first leg support, the first foot portion including a first upper foot portion on an outward side of the first leg support and a first heel portion on an inner side of the first leg support;

a second foot portion connected, via a second foot-leg connection, to the second leg support, the second foot portion including a second upper foot portion on the outward side of the second leg support and a second heel portion on the inner side of the second leg support;

two arm supports at opposite ends of the upper horizontal support, each of the two arm supports connected to the upper horizontal support and extending in an opposite direction from the upper horizontal support relative to the single vertical support;

a first arm support of the two arm supports, at a first end of the upper horizontal support;

a second arm support of the two arm supports, at a second end of the upper horizontal support; and a first hand portion connected to the first arm support, the first hand support creating a first upper flat surface on a first upper external side of the joist profile and having a lower non-right angle connection to the first arm support, wherein each of the first and second foot-leg connections has a respective one of the first and second upper foot portions meeting a respective leg support at a point higher than each respective heel portion, and wherein only the single vertical support spans between the upper horizontal support and the lower horizontal support.

2. The joist beam of claim 1, wherein the single vertical support, the lower horizontal support, the two leg supports, and each of the first and second foot portions are made of aluminum alloy and the joist beam is greater than 1.70 meters in length.

3. The joist beam of claim 1, wherein the joist beam maintains interoperable external dimensions.

4. The joist beam of claim 1, wherein the first foot portion further includes a first toe portion opposite the first heel portion, the first toe portion including a first ridge extending above the first upper foot portion.

5. The joist beam of claim 1, wherein the lower non-right angle connection is less than ninety degrees.

6. The joist beam of claim 1, wherein the joist profile further includes:

a second hand portion connected to the second arm support, the second hand support creating a second upper flat surface on a second upper external side of the joist profile and having the lower non-right angle connection to the second arm support.

7. The joist beam of claim 1, wherein the upper horizontal support and the two arm supports define an upper cavity, the upper cavity having a depth of at least 1.0 inches.

8. A method of constructing a joist beam for use as a formwork component, the method comprising:

obtaining two endcaps for the joist beam;

obtaining a middle joist component, formed from an aluminum alloy material, for the joist beam; and welding a first of the two endcaps to a first end of the middle joist component; and welding a second of the two endcaps to a second end, opposite the first end, of the middle joist component, wherein the middle joist component is longer than six feet and has a joist profile that includes:

a single vertical support having a top and a bottom;

a lower horizontal support having a first midpoint, the first midpoint connected to the bottom of the single vertical support;

an upper horizontal support having a second midpoint, the second midpoint connected to the top of the single vertical support;

two arm supports at opposite ends of the upper horizontal support, each of the two arm supports connected to the upper horizontal support and extending in an opposite direction from the upper horizontal support relative to the single vertical support;

a first arm support of the two arm supports, at a first end of the upper horizontal support;

a second arm support of the two arm supports, at a second end of the upper horizontal support; and a first hand portion connected to the first arm support, the first hand support creating a first upper flat surface on a first upper external side of the joist profile and having a lower non-right angle connection to the first arm support, wherein only the single vertical support spans between the upper horizontal support and the lower horizontal support.

9. The method of claim 8, wherein the joist profile further includes:

two leg supports at opposite ends of the lower horizontal support, each of the two leg supports connected to the lower horizontal support and extending in an opposite direction from the lower horizontal support relative to the single vertical support;

a first leg support, of the two leg supports, at a first end of the lower horizontal support;

a second leg support, of the two leg supports, at a second end of the lower horizontal support;

a first foot portion connected, via a first foot-leg connection, to the first leg support, the first foot portion including a first upper foot portion on an outward side of the first leg support and a first heel portion on an inner side of the first leg support;

a second foot portion connected, via a second foot-leg connection, to the second leg support, the second foot portion including a second upper foot portion on the outward side of the second leg support and a second heel portion on the inner side of the second leg support, wherein each of the first and second foot-leg connections has a respective upper foot portion meeting a respective leg support at a point higher than each respective heel portion.

10. The method of claim 8, wherein the joist profile maintains interoperable external dimensions.

11. The method of claim 8, wherein the upper horizontal support and the two arm supports define an upper cavity, the upper cavity having a depth of at least 1.0 inches.

12. The method of claim 8, further comprising:

utilizing the joist beam to create a joist run of at least 94 feet, the joist run including a maximum of thirteen (13) props and twelve (12) joist beams.

13. A formwork grid system constructed from a plurality of formwork components, the formwork grid system comprising:

a joist run of at least 94 feet, the joist run including a maximum of thirteen (13) props and twelve (12) joist beams, wherein at least one of the joist beams is made of an aluminum alloy and utilizes a joist profile that includes:

a single vertical support having a top and a bottom;

a lower horizontal support having a first midpoint, the first midpoint connected to the bottom of the single vertical support;

an upper horizontal support having a second midpoint, the second midpoint connected to the top of the single vertical support;

two arm supports at opposite ends of the upper horizontal support, each of the two arm supports connected to the upper horizontal support and extending in an opposite direction from the upper horizontal support relative to the single vertical support;

a first arm support of the two arm supports, at a first end of the upper horizontal support;

a second arm support of the two arm supports, at a second end of the upper horizontal support; and a first hand portion connected to the first arm support, the first hand support creating a first upper flat surface on a first upper external side of the joist profile and having a lower non-right angle connection to the first arm support, wherein only the single vertical support spans between the upper horizontal support and the lower horizontal support.

14. The formwork grid system of claim 13, wherein the joist profile further includes:

two leg supports at opposite ends of the lower horizontal support, each of the two leg supports connected to the lower horizontal support and extending in an opposite direction from the lower horizontal support relative to the single vertical support;

a first leg support, of the two leg supports, at a first end of the lower horizontal support;

a second leg support, of the two leg supports, at a second end of the lower horizontal support;

a first foot portion connected, via a first foot-leg connection, to the first leg support, the first foot portion including a first upper foot portion on an outward side of the first leg support and a first heel portion on an inner side of the first leg support;

a second foot portion connected, via a second foot-leg connection, to the second leg support, the second foot portion including a second upper foot portion on the outward side of the second leg support and a second heel portion on the inner side of the second leg support, wherein each of the first and second foot-leg connections has a respective upper foot portion meeting a respective leg support at a point higher than each respective heel portion.

15. The formwork grid system of claim 13, wherein the at least one joist beam maintains interoperable external dimensions.

16. The formwork grid system of claim 13, wherein the first foot portion further includes a first toe portion opposite the first heel portion, the first toe portion including a first ridge extending above the first upper foot portion.

17. The formwork grid system of claim 13, wherein the upper horizontal support and the two arm supports define an upper cavity, the upper cavity having a depth of at least 1.0 inches.

* * * * *